US007226002B2

(12) United States Patent
Luo

(10) Patent No.: US 7,226,002 B2
(45) Date of Patent: Jun. 5, 2007

(54) SEALING DEVICE FOR A WATERING NOZZLE ASSEMBLY

(76) Inventor: Shun-Nan Luo, P.O. Box 487, Chang-Hua City 500 (TW)

( * ) Notice: Subject to any disclaimer, the term of this patent is extended or adjusted under 35 U.S.C. 154(b) by 106 days.

(21) Appl. No.: 11/199,849

(22) Filed: Aug. 10, 2005

(65) Prior Publication Data

US 2007/0034719 A1 Feb. 15, 2007

(51) Int. Cl.
*B05B 7/02* (2006.01)

(52) U.S. Cl. ..... 239/526; 239/390; 239/443; 239/448; 239/525; 239/569; 239/583

(58) Field of Classification Search ..... 239/526, 239/390, 391, 394, 435, 525, 583, 443, 448, 239/569, 527; 137/625.45, 625.48; 251/314
See application file for complete search history.

(56) References Cited

U.S. PATENT DOCUMENTS 4,909,443 A * 3/1990 Takagi ..... 239/440
5,232,162 A * 8/1993 Chih ..... 239/394
5,979,800 A * 11/1999 Takagi ..... 239/440

* cited by examiner

*Primary Examiner*—Dinh Q. Nguyen

(57) ABSTRACT

A watering nozzle assembly includes a core tube received in the barrel of the nozzle. A first seal ring and a second seal ring are respectively mounted to a second end of the core tube, and a plurality of apertures are defined radially in the core tube and located between the first and second seal rings. A control rod pivotably connected to an operation bar movably seals the first end of the core tube. A nozzle is threadedly connected to the core tube. A block is fixedly connected to the second end of the core tube and removably seals the nozzle. The nozzle cab be moved relative to the core tube to allow water flowing from the gap between the block and the stepped surface in the nozzle. The first and second seal rings ensure that the nozzle assembly does not leak whichever status it is operated.

7 Claims, 8 Drawing Sheets

SEALING DEVICE FOR A WATERING NOZZLE ASSEMBLY

FIELD OF THE INVENTION

The present invention relates to a sealing device for a watering nozzle assembly wherein the core tube includes two seal rings located on two ends of the outlets so that leakage can be avoided.

BACKGROUND OF THE INVENTION

A conventional watering nozzle assembly is shown in FIGS. 7 and 8 and generally includes a connector 80 with a first threaded inner periphery 81 so as to be connected with a hose or the like, and a threaded outer periphery 84 is defined in an outer periphery of the connector 80 so as to be threadedly connected to a second threaded inner periphery 91 of a nozzle 90. A first seal ring 82 and a second seal ring 83 are mounted to the connector 80 and located such that the first threaded inner periphery 84 is located between the two seal rings 82, 83. The nozzle 90 includes a diverse outlet 92 and a stepped surface 93 is defined in an inner periphery of the nozzle 90. A block 200 is fixed to a distal end of the connector 80 by a screw 300 which extends through the block 200 and is threadedly connected to a recess 86 in the connector 80. A seal plate 100 is attached to an inside of the block 200 and can be matched with the stepped surface 93 to seal the outlet 92 as shown in FIG. 7. When rotating the nozzle 90 away from the connector 80 as shown in FIG. 8, water flows out from the outlet 85 of the connector 80 and passes through the gap between the block 200 and the stepped surface 93.

The nozzle 90 has to be rotated to tightly contact the sealing plate 100 against the stepped surface 95, or leakage may happen and this action requires a lot of efforts and might not be suitable for kids or users who do not have strong muscles.

The present invention intends to provide a watering nozzle assembly which includes two sealing mechanism to ensure the sealed status.

SUMMARY OF THE INVENTION

The present invention relates to a watering nozzle assembly that comprises a handle with a passage defined therethrough and a barrel is connected to the handle. The passage communicates with an interior of the barrel. A core tube is received in the barrel and has a first end fixedly engaged with the a first end of the barrel and a first seal ring and a second seal ring are respectively mounted to a second end of the core tube. A plurality of apertures are defined radially in the core tube and located between the first and second seal rings.

A control rod connected to an operation bar movably extends through a second end of the barrel and a first end of the control rod removably seals the first end of the core tube. A nozzle is threadedly engaged with the core tube and has a central passage and an outlet which is in communication with the central passage. A block is fixedly connected to the second end of the core tube and removably seals the central passage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
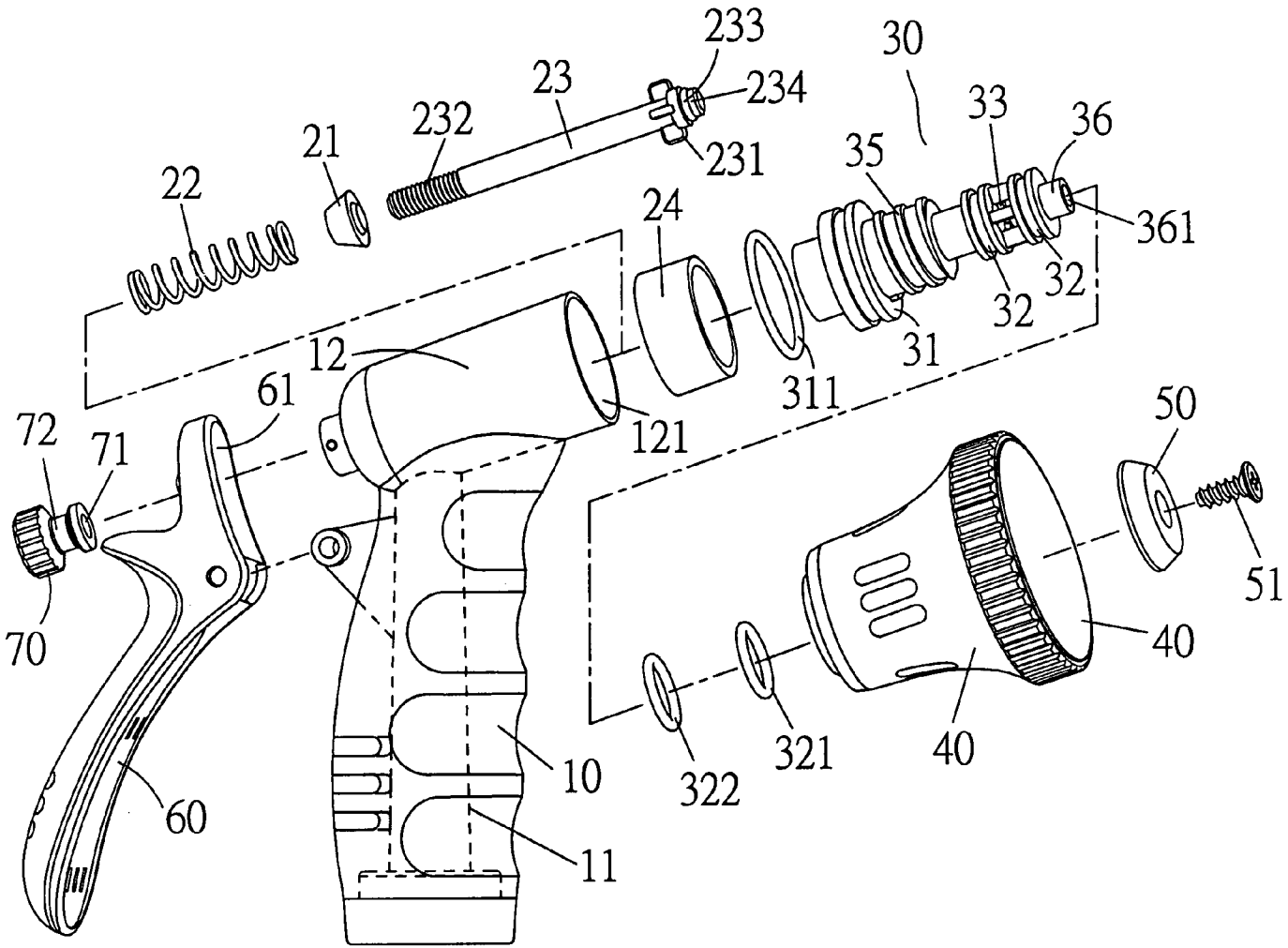
FIG. 1 is an exploded view to show the watering nozzle assembly of the present invention.
Figure 2:
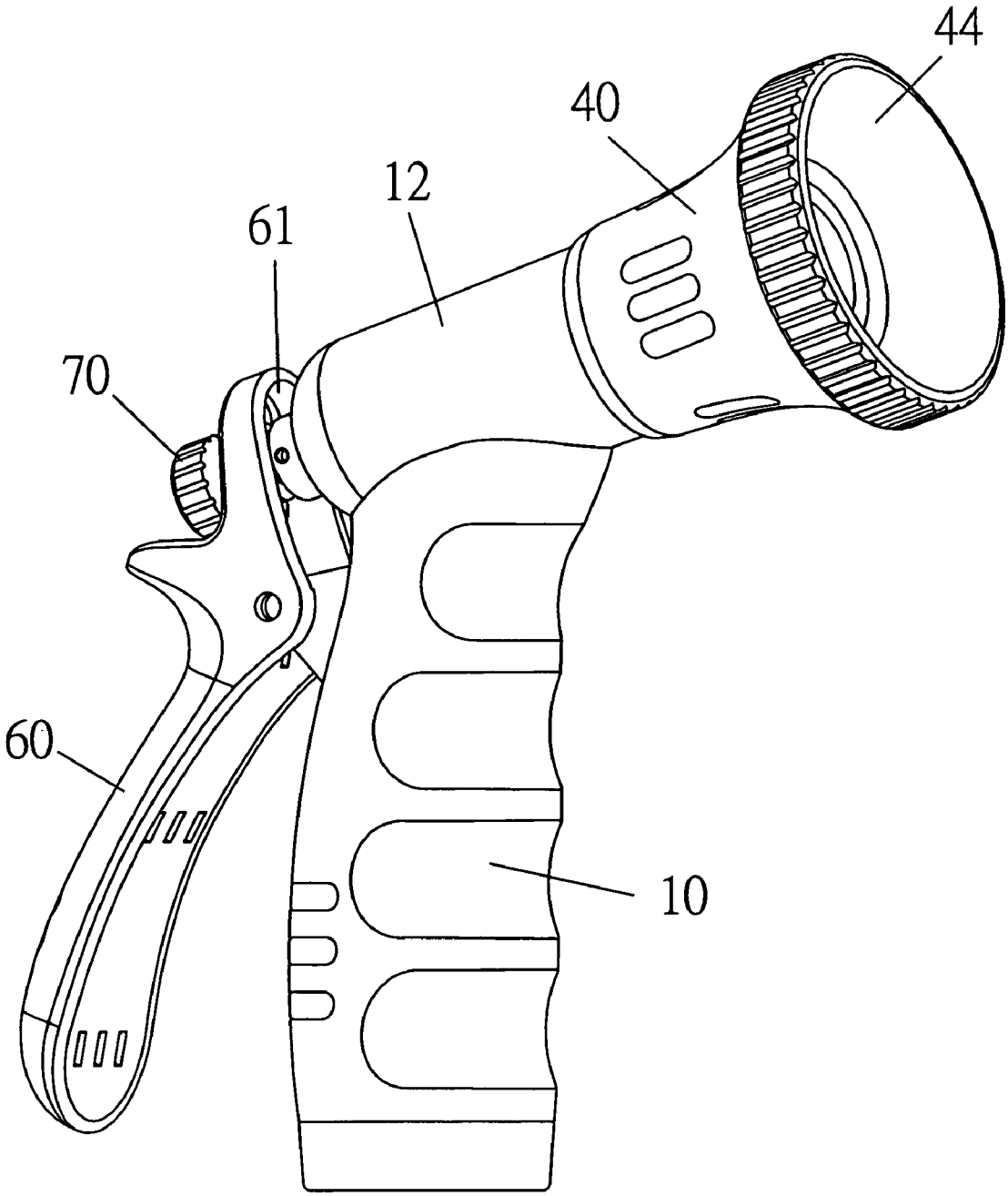
FIG. 2 is a perspective view to show the watering nozzle assembly of the present invention.

Referring to FIGS. 1 to 4, the watering nozzle assembly of the present invention comprises a handle 10 with a passage 11 defined therethrough and a barrel 12 is connected to the handle 10. The passage 11 communicates with an interior 121 of the barrel 12 so that water introduced into the passage 11 can flow into the interior 121 of the barrel 12.

A core tube 30 is received in the barrel 12 and has a first end fixedly engaged with the first end of the barrel 12. The core tube 30 includes a flange 31 extending radially therefrom and a seal ring 311 is mounted to the flange 31 so that water does not leak from the possible gap between the flange 31 and the inner periphery of the interior 121 of the barrel 12. A bush 24 is fixed engaged with the interior 121 of the first end of the barrel 12 so that the flange 31 is connected to an end of the bush 24. The core tube 30 has a threaded outer periphery 35. A first seal ring 321 and a second seal ring 322 are respectively engaged with two grooves 32 defined in a second end of the core tube, and a plurality of apertures 33 are defined radially in the core tube 30 and located between the first and second seal rings 321, 322.

A control rod 23 movably extends through a rear opening 122 in a second end of the barrel 12 and a first end of the control rod 23 includes an insertion 234 axially extending therefrom and a seal ring 233 is mounted to the insertion 234. The insertion 234 is removably inserted into a central path 341 defined through the core tube 30 so as to movably seal the first end of the core tube 30. A seal member 21 is fixedly engaged with the rear opening 122 and a plurality of ribs 231 extend from the first end of the control rod 23. A spring 23 is mounted to the control rod 23 and two ends of the spring 23 are in contact with the seal member 21 and the seal member 21. An operation bar 60 is pivotably connected to the handle 10 and the second end of the control rod 23 extends through a hole 61 in the operation bar 60 and is connected to a knob 70. The second end of the control rod 23 includes a threaded section 232 which extends out from the rear opening 122 of the barrel 12 and is threadedly connected to a threaded hole 71 in the knob 70.

A nozzle 40 having a threaded inner periphery 42 which is threadedly engaged with the threaded outer periphery 35 of the core tube 30. The first end of the barrel 12 is inserted into an annular recess 43 defined in an end of the nozzle 40.

An outlet 44 is defined in the other end of the nozzle 40 and communicates with a central passage 41 in the nozzle 40. A block 50 is mounted to a protrusion 36 on the second end of the core tube 30 and a screw 51 is threadedly connected to a threaded hole 361 in the protrusion 36 so as to fixedly position the block 50. The nozzle 40 has a stepped surface 45 defined in the inner periphery of the central passage 41 and the block 50 is removably engaged with the stepped surface 45 to seal the central passage 41.

Figure 3:
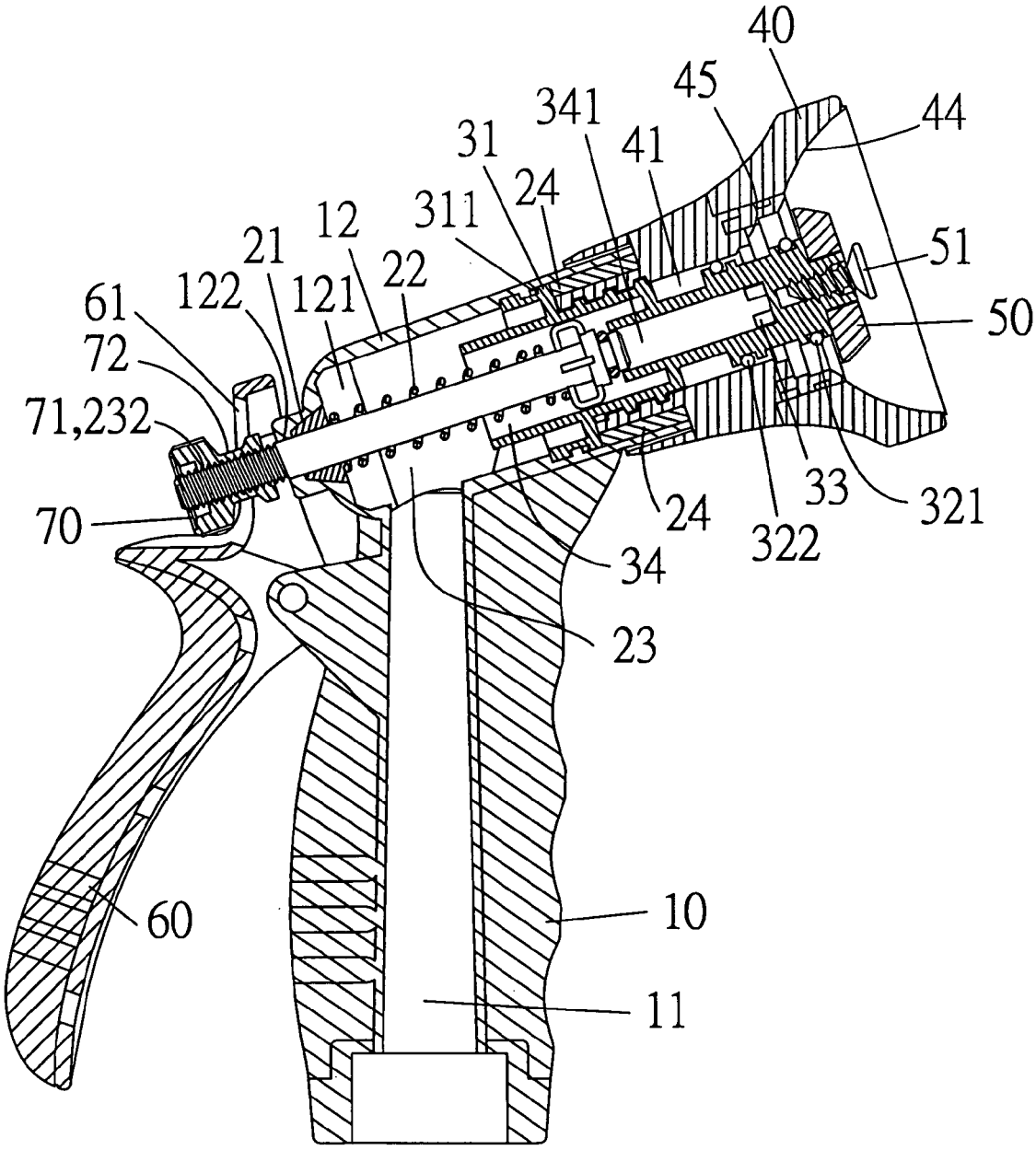
FIG. 3 is a cross sectional view to show the watering nozzle assembly of the present invention.
Figure 4:
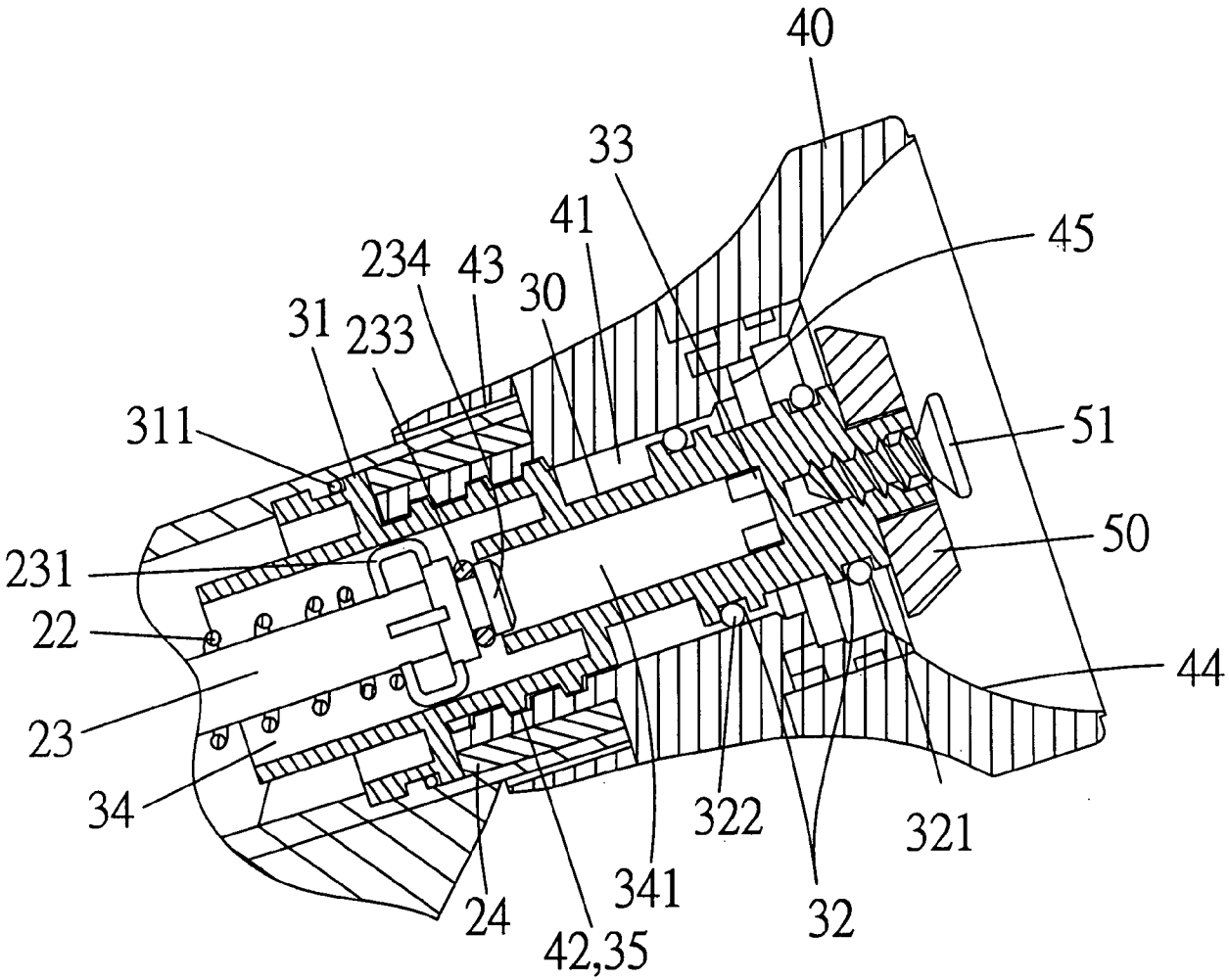
FIG. 4 is an enlarged cross sectional view to show that the nozzle is moved away from the barrel so as to form a gap between the block and the central passage of the nozzle.
Figure 5:
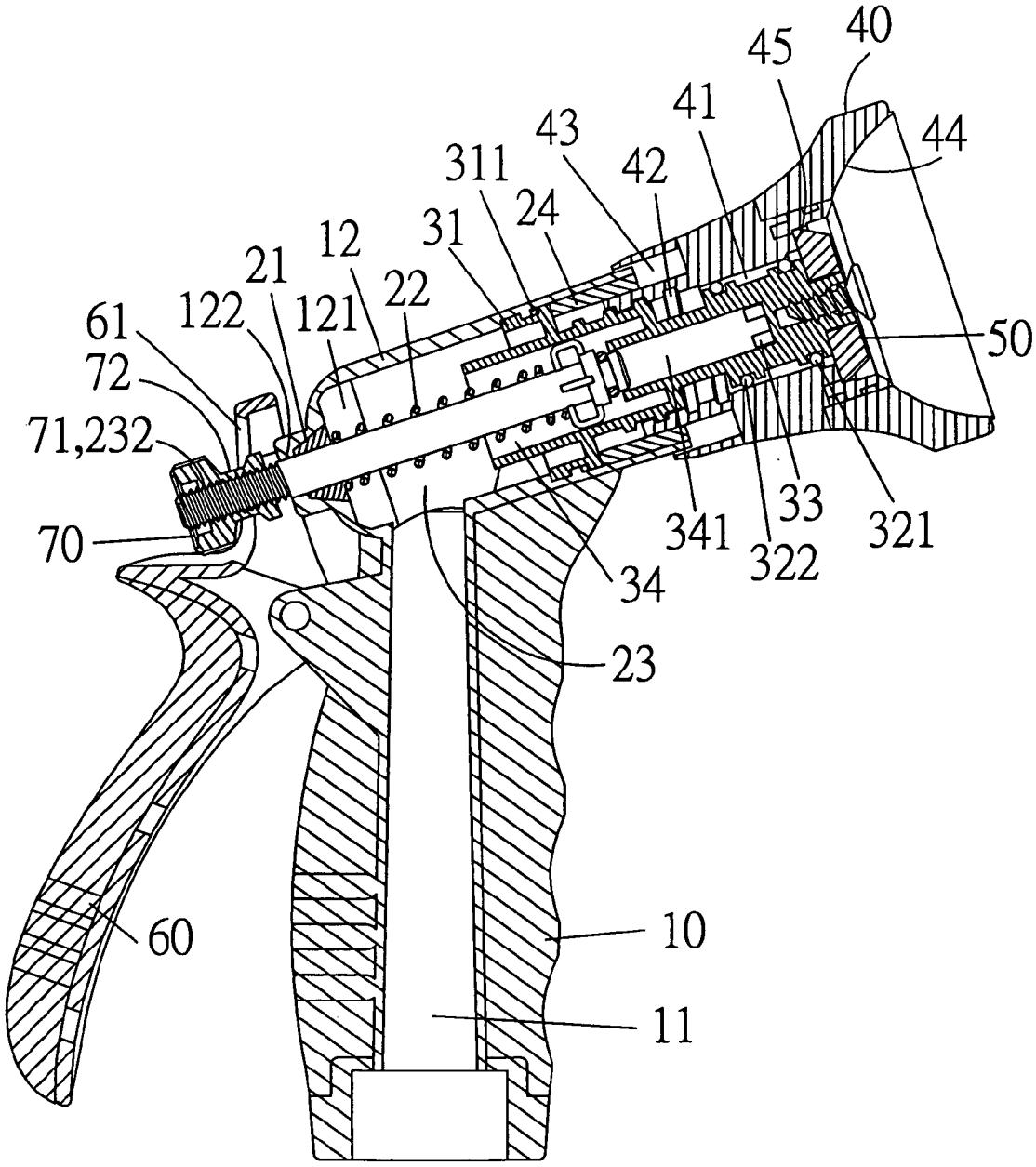
FIG. 5 is a cross sectional view to show that the nozzle is moved toward the barrel so that the block seals the central passage of the nozzle.
Figure 6:
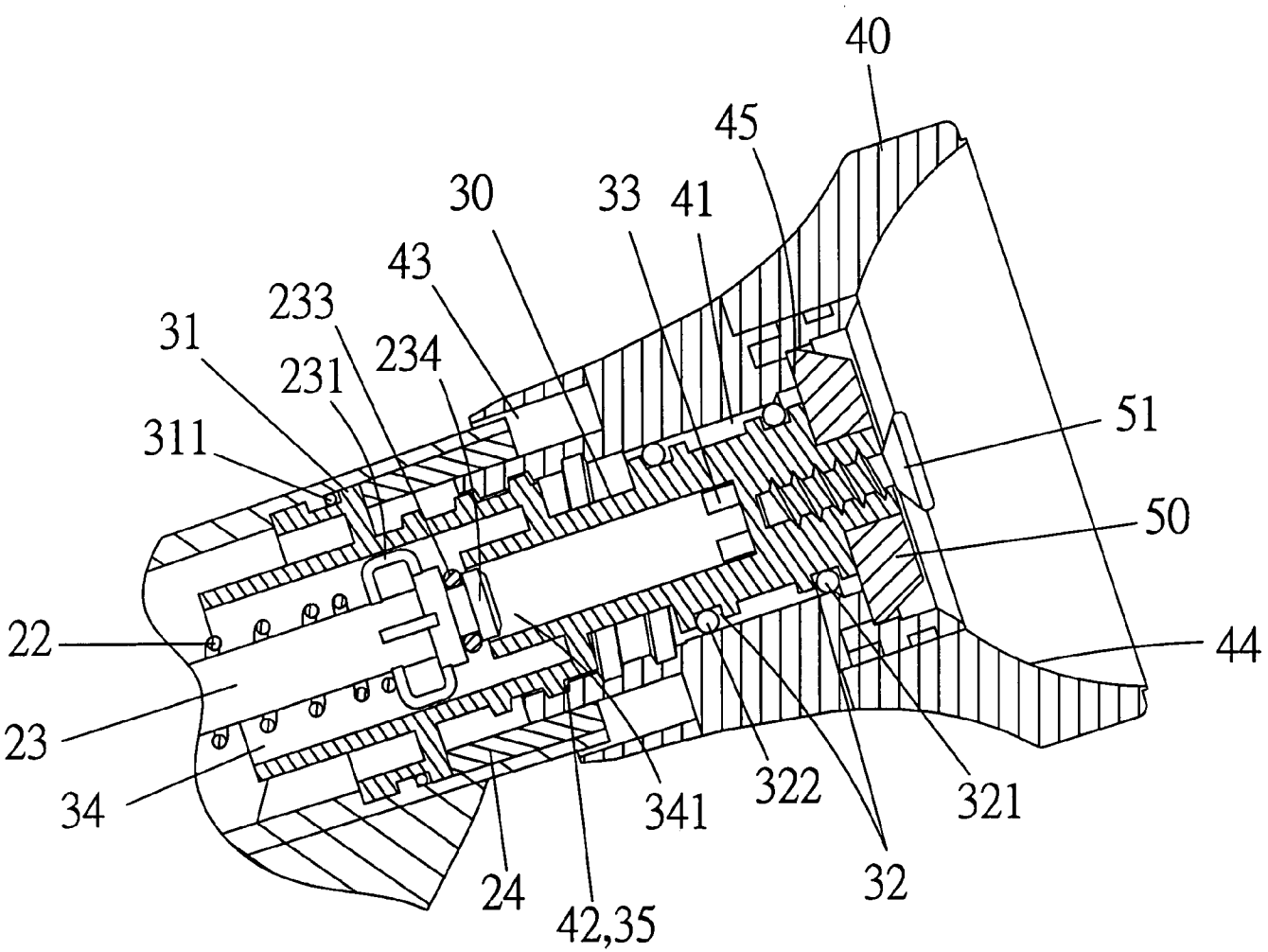
FIG. 6 is an enlarged view to show that the block seals the central passage of the nozzle.
Figure 7:
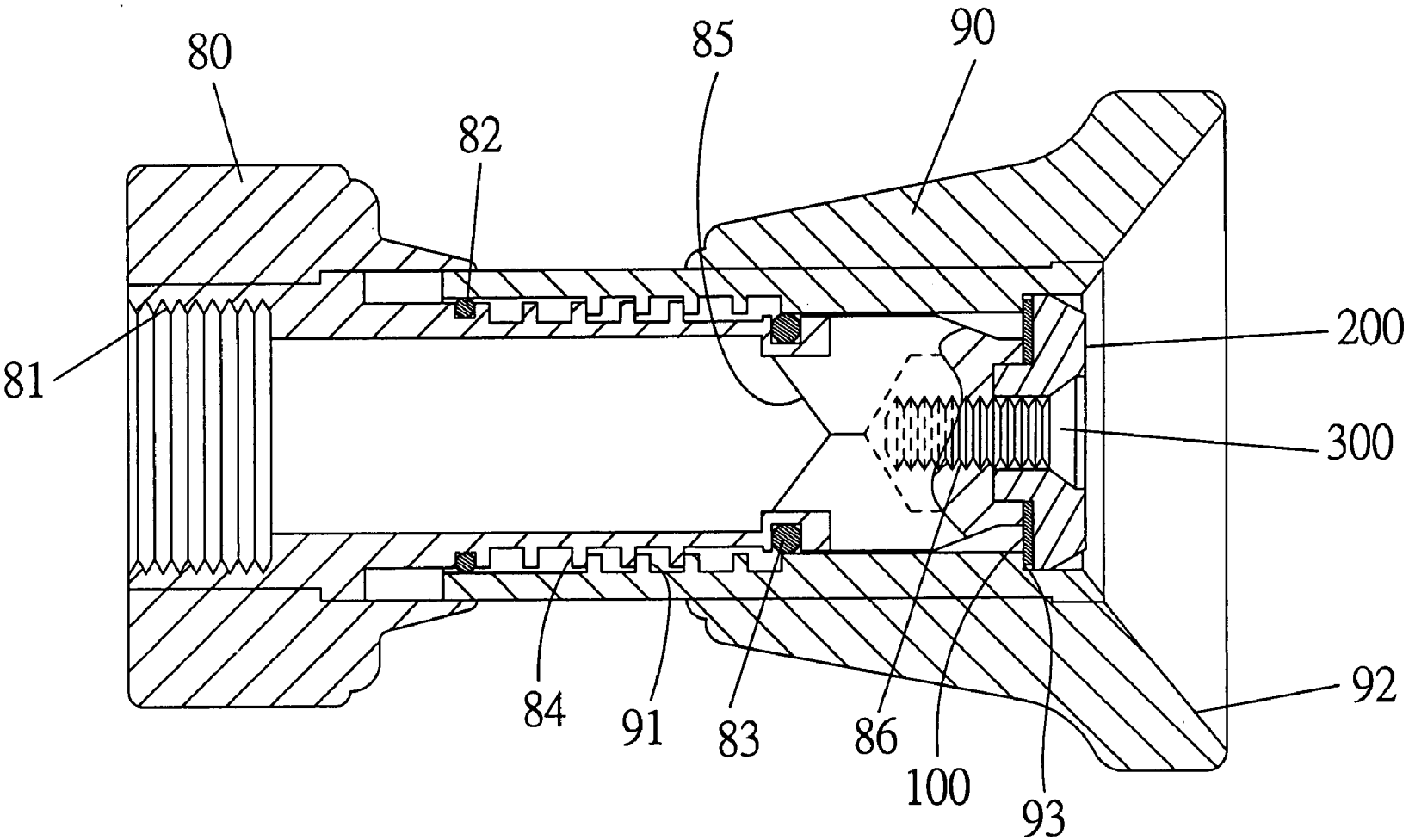
FIG 7 (PRIOR ART)
FIG. 7 shows a conventional watering nozzle assembly in sealed status.
Figure 8:
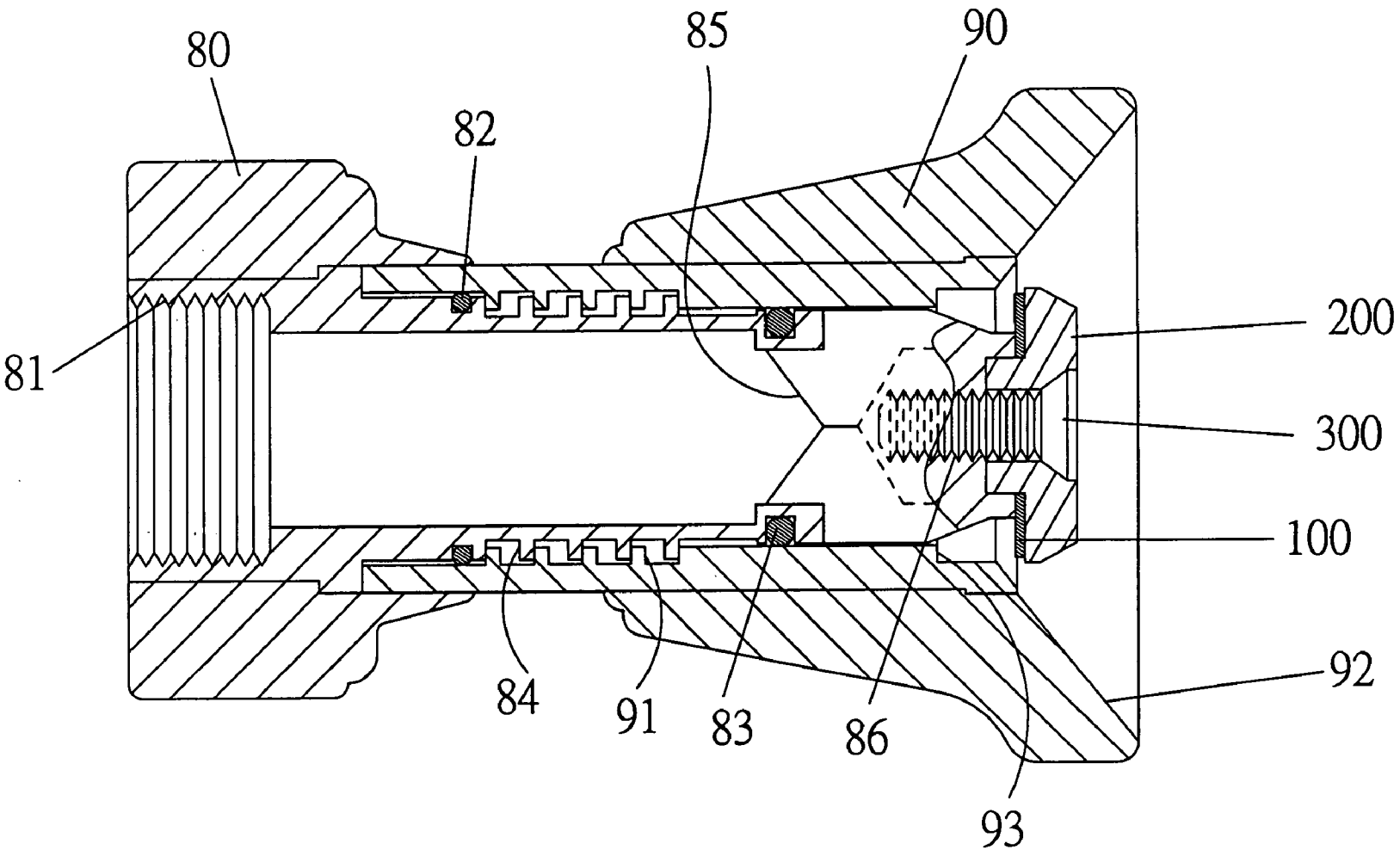
FIG 8 (PRIOR ART)
FIG. 8 shows that the conventional watering nozzle assembly is in operation status.

When pivoting the operation bar 60 toward the handle 10, the control rod 23 is pulled away from the core tube 30 so that the water is allowed to enter into the central path 341 of the core tube 30. If the user rotates the nozzle 40 toward the barrel 12 as shown in FIGS. 3 and 4, a gap is defined between the block 50 and the stepped surface 45, so that water goes through the apertures 33 of the core tube 30, the gap and the outlet 44. On the contrary, if the nozzle 40 is rotated to be away from the barrel 12, the stepped surface 45 and the block 50 are matched with each other, and the central passage 41 is sealed. It is noted that the first and second seal rings 321, 322 prevents leakage when the stepped surface 45 and the block 50 are matched with each other, and the second seal ring 322 prevents leakage when the stepped surface 45 and the block 50 are separated.

While we have shown and described the embodiment in accordance with the present invention, it should be clear to those skilled in the art that further embodiments may be made without departing from the scope of the present invention.

What is claimed is:

1. A watering nozzle assembly comprising:

a handle with a passage defined therethrough and a barrel connected to the handle, the passage communicating with an interior of the barrel;

a core tube received in the barrel and having a first end fixedly engaged with a first end of the barrel, the core tube having a threaded outer periphery, a first seal ring and a second seal ring respectively mounted to a second end of the core tube, a plurality of apertures defined radially in the core tube and located between the first and second seal rings;

a control rod movably extending through a second end of the barrel and a first end of the control rod removably sealing the first end of the core tube;

a nozzle having a threaded inner periphery which is threadedly engaged with the threaded outer periphery of the core tube, the nozzle having a central passage and an outlet which is in communication with the central passage, and a block fixedly connected to the second end of the core tube and removably sealing the central passage.

2. The assembly as claimed in claim 1, wherein the nozzle has a stepped surface defined in the threaded inner periphery of the central passage and the block is removably engaged with the stepped surface.

3. The assembly as claimed in claim 1, wherein a spring is mounted to the control rod and a seal member is engaged with a rear opening defined through the second end of the barrel, two ends of the spring are in contact with the seal member and ribs extending from the first end of the control rod.

4. The assembly as claimed in claim 3, wherein an operation bar is pivotably connected to the handle and a second end of the control rod extends through a hole in the operation bar and is connected to a knob.

5. The assembly as claimed in claim 4, wherein the second end of the control rod includes a threaded section which extends out from the rear opening of the barrel and is threadedly connected to a threaded hole in the knob.

6. The assembly as claimed in claim 1, wherein the first end of the control rod includes an insertion axially extending therefrom and a seal ring is mounted to the insertion, the insertion is removably inserted into a central path defined through the core tube.

7. The assembly as claimed in claim 1, wherein the core tube includes a flange extending radially therefrom and a seal ring is mounted to the flange, a bush is fixed engaged with the interior of the first end of the barrel so that the flange is connected to an end of the bush.

* * * * *